United States Patent [19]

Mumford

[11] 4,322,011

[45] Mar. 30, 1982

[54] SIDE SEAL CLOSURE

[75] Inventor: George V. Mumford, Toledo, Ohio

[73] Assignee: Owens-Illinois, Inc., Toledo, Ohio

[21] Appl. No.: 114,032

[22] Filed: Jan. 21, 1980

[51] Int. Cl.[3] ..... B65D 41/04

[52] U.S. Cl. ..... 215/270; 215/341

[58] Field of Search ..... 215/270, 341, 344, DIG. 1, 215/329

[56] References Cited

U.S. PATENT DOCUMENTS

| | | | |
|---|---|---|---|
| 3,272,369 | 9/1966 | Grimsley | 215/329 |
| 3,595,418 | 7/1971 | Adcock | 215/344 X |
| 4,209,102 | 6/1980 | Dunn | 215/341 X |

FOREIGN PATENT DOCUMENTS

| | | |
|---|---|---|
| 587755 | 5/1977 | Switzerland . |
| 607702 | 10/1978 | Switzerland . |
| 1079700 | 8/1967 | United Kingdom . |
| 1532767 | 11/1978 | United Kingdom . |
| 1547854 | 6/1979 | United Kingdom . |

*Primary Examiner*—Donald F. Norton

*Attorney, Agent, or Firm*—John R. Nelson; Myron E. Click; David H. Wilson

[57] ABSTRACT

The invention comprises a threaded plastic closure for a container for pressured fluids, such as a carbonated beverage bottle. The panel portion of the closure abuts the top of the bottle neck or finish to form a top seal, and the wall portion has an internal annular sealing rib for creating a seal on an outside cylindrical portion of the bottle finish. The connecting material between the side seal rib and the top seal of the closure is deformed outwardly, away from the finish and is of reduced wall thickness to provide a flexible connection between the top seal and the side sealing rib.

7 Claims, 5 Drawing Figures

SIDE SEAL CLOSURE

BACKGROUND OF THE INVENTION

Plastic closures have become economically desirable in the beverage bottling industry. However, standard glass bottles have reliable dimensional tolerances for outside diameter of finish only, and do not have reliable tolerances for inside diameters or for the top surface of the finish. When closures are designed to seal on the inside or top of the bottle, the bottles cannot be made with the degree of precision required for a durable, high pressure plastic-to-glass seal. Also, closures employing only a top seal are subject to failure caused by internal pressure lifting the cap and breaking the seal. A final consideration is that the cap, while it must seal high pressures reliably during storage and handling, must be easily removable by the consumer.

SUMMARY OF THE INVENTION

The invention comprises a threaded plastic closure for containers of high pressure fluid, such as carbonated beverage bottles. The closure has a top panel section from which depends a downwardly extending annular skirt section. The inside of the skirt is threaded to engage the threaded bottle finish. The panel is provided with a depending annular rib which forms a secondary seal on the top surface of the bottle neck. The skirt defines an internal side sealing rib which makes a primary seal on an outside cylindrical surface portion of the bottle finish, directly above the threaded portion of such finish.

A flexible annular section between the side sealing rib and the top seal rib of the panel is contoured so that upward pressure on the top panel increases the radial compressing force on the side sealing rib.

DESCRIPTION OF PREFERRED EMBODIMENTS

Figure 1:
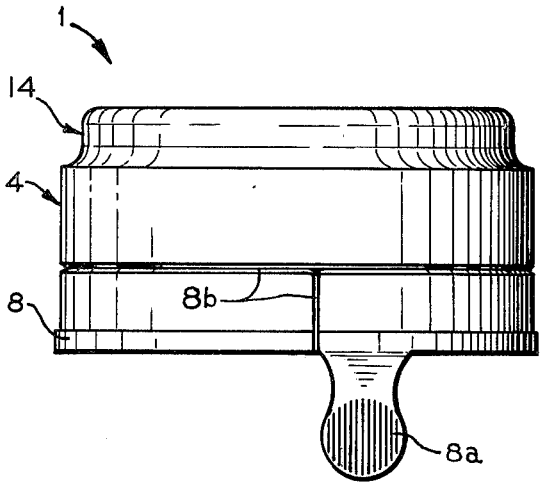
FIG. 1 is an elevational view of a closure embodying this invention.
Figure 2:
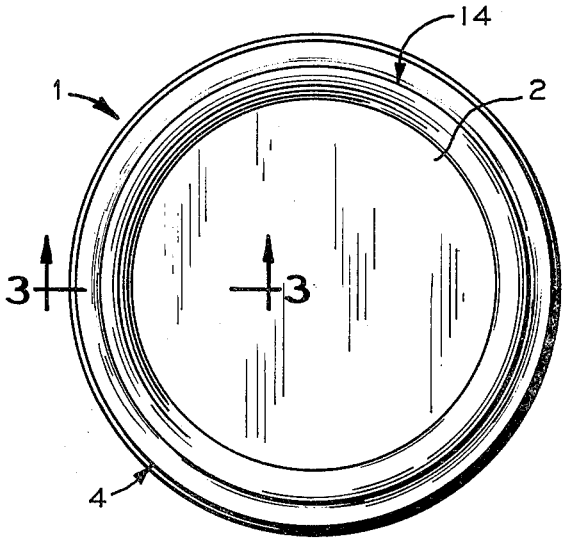
FIG. 2 is a plan view of FIG. 1.
Figure 3:
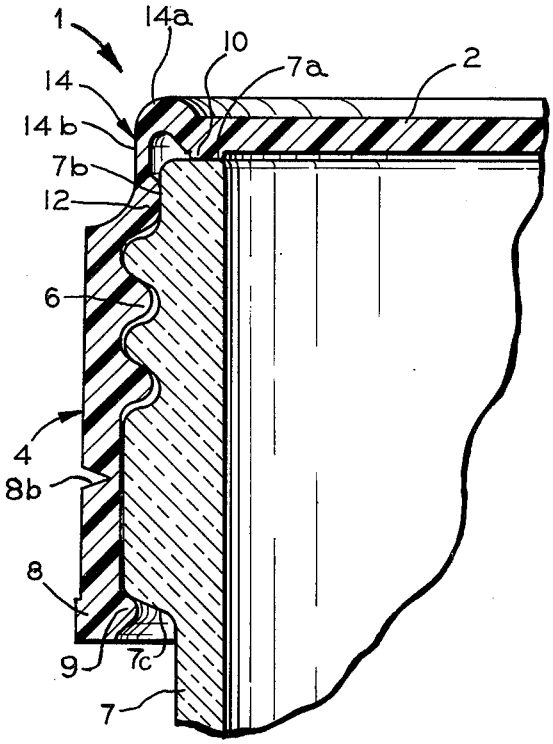
FIG. 3 shows an enlarged scale sectional view taken on the plane 3—3 of FIG. 2 with the closure threaded on a glass bottle.

Referring to FIGS. 1-3 of the drawings, there is shown a cap or closure 1, integrally molded from a thermoplastic or thermosetting material having some degree of elasticity, such as polypropylene. Cap 1 has a top panel section 2 from the periphery of which depends an annular skirt section 4. The inside of skirt section 4 has threads 6 formed thereon to engage the threaded finish 7 of a glass bottle. If desired, the bottom portion of the skirt section 4 may be extended downwardly to define a conventional tamper-proof ring 8, having an internally projecting rib 9 engaging beneath a shoulder *7c* provided on the bottle finish, plus a removal tab 8*a* and score lines 8*b*.

The panel 2 of the closure 1 has an integral, downwardly projecting annular seal member 10, which abuts the top *7a* of a bottle finish, forming a top seal when the cap threads 6 are fully engaged with the threads of the bottle. On the inside of the skirt section 4, below the top panel 2 but above the threaded portion 6, there is provided an integral, inwardly projecting annular rib 12, which is dimensioned to engage an outside cylindrical surface *7b* of the bottle finish 7 with an interference fit and thereby form a primary seal with the bottle finish. The top seal rib 10 is obviously of smaller diameter than side seal rib 12.

The regions of the closure 1 in the vicinity of the top sealing rib 10 and the side sealing rib 12 are necessarily relatively rigid. Interconnecting these relatively rigid regions is an integral annular connecting portion 14 which is outwardly and upwardly bulged relative to the panel portion 2 and incorporates a relatively thin-walled vertical portion 14*b* immediately adjacent to the side sealing rib portion of the closure 1. Thin-walled portion 14*b* obviously has a greater degree of flexibility than any of the remaining portions of the closure. Thus the interference fit of side sealing rib 12 on the side seal surface *7a* of the container finish 7 produces an outward pre-stress on the flexible connecting section 14*b*.

After the closure 1 is applied to the container, and the internal container pressure increases, the top panel section 2 of cap 1 will tend to assume a domed configuration and then may lift the depending top seal rib 10 from the top surface *7a* of the bottle finish 7. The result of these displacements of the panel portion is to produce an upward and inward deformation of the flexible annular area 14*b* and hence to increase the radially compressing force exerted by the side sealing rib 12 on the adjacent cylindrical container wall surface *7b*, thereby increasing the effectiveness of the side seal.

The flexible annular wall 14*b* may be manufactured in various thicknesses to adapt the cap to applications requiring specified relations of side seal pressure requirements to removing force requirements.

Figure 4:
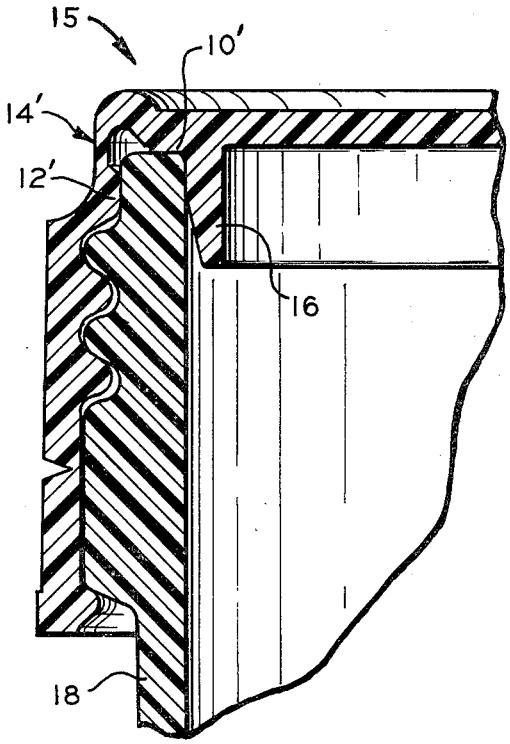
FIG. 4 is a view similar to FIG. 3 but illustrating another embodiment of the invention suitable for sealing a plastic bottle.

FIG. 4 shows a further embodiment of the invention suitable for sealing a plastic bottle 18 which has a more flexible bottle finish. In this embodiment, the closure 15 is constructed with integral annular plug member 16 depending from the top inside of the panel 2' within the circumference of the top seal member 10'. This annular plug 16 abuts the inside of the plastic bottle finish 18 to provide support against the side sealing force of the side annular seal rib 12' All other portions of the closure 15 are the same as previously described, and the closure functions to maintain a side seal formed by rib 12' in the same manner.

Figure 5:
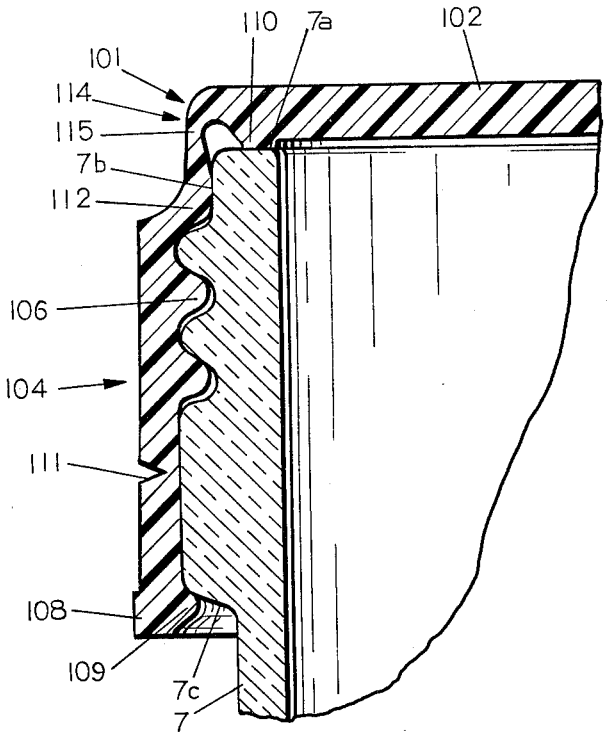
FIG. 5 is an enlarged scale vertical sectional view of a modified closure configuration embodying this invention shown in assembled relation to a container.

In FIG. 5 there is disclosed a modified configuration of a closure embodying this invention which utilizes an essentially flat planar surface for the panel portion of the closure to permit the convenient application of decoration on such surface. As is the case in the other modifications, panel 102 of the closure 101 has an integral, downwardly projecting annular seal member 110, which abuts the top *7a* of the bottle finish, forming a top seal when the cap threads 106 are fully engaged with the threads of the bottle. On the inside of the skirt section 104, below the top panel 102, but above the threaded portion 106, there is provided an integral, inwardly projecting, annular rib 112 which is dimensioned to engage outside cylindrical surface *7b* of the bottle finish 7 with an interference fit, to thereby form a primary side seal with the bottle finish. The top seal rib 110 is obviously of small diameter than the side seal rib 112.

The regions of the closure 101 in the vicinity of the top sealing rib 110 and the side sealing rib 112 are necessarily relatively rigid. Interconnecting these relatively rigid regions is an integral annular connecting portion 114 which includes a portion 115 of reduced thickness relative to the thickness of the panel portion overlying the top sealing rib 110 and the side wall portion adjacent to the side sealing rib 112. Such thin walled portion 115 obviously has a greater degree of flexibility than the adjacent portions of the closure. Thus the interference fit of side sealing rib 112 on the side seal surface 7*a* of the container finish 7, produces an outward prestress on the flexible connection 115.

The operation of the closure 101 shown in FIG. 5 is identical to that heretofore described. After the closure 101 is applied to the container, and the internal container pressure increases, the top panel section 102 of closure 101 will tend to assume a domed configuration and then may lift the depending top seal rib 110 from the top surface 7*a* of the bottle finish 7. The result of these displacements of the panel portion is to produce an inward deformation of the flexible annular connecting area 114 and, hence, to increase the radially compressing force exerted by the side sealing rib 112 on the adjacent cylindrical inner wall surface 7*b* of the container, thereby increasing the effectiveness of the side seal.

If desired, an integral pilfer-proof band 108 may be provided on the bottom end of skirt 104, having an internal shoulder 109 engaging container shoulder 7*c* and a score line 111.

Although the invention has been described in terms of specified embodiments which are set forth in detail, it should be understood that this is by illustration only and that the invention is not necessarily limited thereto, since alternative embodiments will become apparent to those skilled in the art in view of the disclosure. Accordingly, modifications are contemplated which can be made without departing from the spirit of the described invention.

What is claimed is:

1. A plastic closure for sealing a container of pressured fluid, said container having a threaded neck and an external cylindrical sealing wall above the neck threads, said closure comprising a top panel section, an integral depending annular skirt section defining internal threads to cooperate with the container neck threads, an annular side sealing rib forming a series connected part of said skirt section extending inwardly from the inside surface of said skirt above said threads and having an internal surface dimensioned to form an interference fit only with said external cylindrical sealing wall of said container, means on said panel portion engaging the top of said container finish to form a top seal with the end face of the container neck, and a flexible annular wall section integrally connecting the periphery of said top panel section and said side sealing rib, said flexible annular wall section being of less thickness than said panel and said annular sealing rib, whereby increased internal container pressure on said top panel section increases the radial compressing force on said side sealing rib.

2. The closure of claim 1 wherein said flexible annular wall section is bulged upwardly relative to said panel section and the portion thereof immediately adjacent said annular side sealing rib is of reduced wall thickness to provide the desired flexibility.

3. A container for pressurized fluids comprising, in combination, a container neck portion having external threads formed thereon and an external cylindrical sealing surface formed above said neck threads, a molded plastic closure for said container comprising a top panel section having an integral depending annular skirt section, said skirt section having integral internal threads formed thereon to cooperate with said container neck threads, an integral annular side sealing rib forming a series connected part of said skirt section extending inwardly from the inside surface of said skirt at a position above said threads and having an internal surface engageable only with said external cylindrical sealing surface of said container by an interference fit, means on said panel section engaging the end face of said container to form a top seal, and a flexible annular wall section integrally connecting the periphery of said panel section and said side sealing rib, said flexible annular wall section being of less thickness than said panel section and said annular sealing rib, whereby increased pressure within said container producing a vertical displacement of said top seal from the container will concurrently produce an increased radial compressive force between said annular side sealing rib and said external cylindrical sealing surface on said container.

4. The container of claim 3 wherein said flexible annular wall section is bulged upwardly relative to said panel section and joins said annular side sealing rib of the closure through a vertical wall portion of reduced thickness.

5. The container of claim 3 or 4 wherein said means on said panel section forming a top seal with the end face of said neck of the container comprises a depending annular rib having a diameter significantly smaller than the diameter of said annular side sealing rib.

6. A plastic closure for sealing a container, said container having a threaded neck and an external cylindrical sealing wall above the neck threads, said closure comprising a circular top panel section, an integral annular skirt section secured to the periphery of said top panel section, said skirt section comprising, in directly connected vertical sequence, a flexible annular wall section having an arcuate cross-section, an annular rib having an internal surface dimensioned to form an interference fit with only said external cylindrical wall of said container, and an internally threaded portion secured to the bottom of said annular rib and cooperable with said container neck threads, said flexible annular wall section being of less thickness than said panel section and said annular rib, whereby increased internal container pressure concurrently applies an axial tension and a radial compression force on said annular rib.

7. The plastic closure of claim 6 wherein said flexible annular wall section is bulged upwardly relative to said panel section.

* * * * *